US005386091A

United States Patent [19]

Clancy

[11] Patent Number: 5,386,091

[45] Date of Patent: Jan. 31, 1995

[54] LOW PROFILE KEYSWITCH

[75] Inventor: Kevin F. Clancy, Cypress, Tex.

[73] Assignee: Compaq Computer Corporation, Houston, Tex.

[21] Appl. No.: 267,581

[22] Filed: Jun. 29, 1994

Related U.S. Application Data

[63] Continuation of Ser. No. 44,593, Apr. 8, 1993, abandoned.

[51] Int. Cl.[6] ..... H01H 1/10

[52] U.S. Cl. ..... 200/517; 200/344; 200/345; 200/512

[58] Field of Search ..... 200/510, 511, 512, 515, 200/517, 520, 341, 344, 345

[56] References Cited

U.S. PATENT DOCUMENTS

| | | | |
|---|---|---|---|
| 4,354,081 | 10/1982 | Serras-Paulet | 200/517 |
| 4,408,252 | 10/1983 | Voge et al. | 200/517 |
| 4,451,719 | 5/1984 | Lauterburg et al. | 200/159 R |
| 4,855,548 | 8/1989 | Curley et al. | 200/345 |
| 4,939,324 | 7/1990 | English et al. | 200/345 |
| 5,115,106 | 5/1992 | Weiland et al. | 200/517 |
| 5,145,058 | 9/1992 | Lee | 200/517 |
| 5,173,578 | 12/1992 | Tama | 200/512 |
| 5,256,843 | 10/1993 | Chiba et al. | 200/517 |

OTHER PUBLICATIONS

RT Series Membrane Keyboard w/Zilog MPU(Z8614), Jan., 1992; NMB Technologies, Inc. of Chatsworth, Calif. (8 pages including 1 page of FIG. 4 having a date of May 16, 1988 for an elevation view of a keyswitch for Minebea Co., Ltd.

Fujitsu Microelectronics, Inc., Electronic Components Division, Keyboard Presentation to Compaq Computer Corporation, Apr. 1, 1992 (20 pages total).

FKB7211 Low-Profile Membrane Laptop/Notebook Standard Keyboard; ©1991 by Fujitsu Limited and Fujitsu Microelectronics, Inc. (2 pages total).

FKB7300 Low-Profile Membrane Custom Keyboard; ©1991 by Fujitsu Limited and Fujitsu Microelectronics, Inc., Edition 1.0 (2 pages total).

New Low-Profile Desktop Keyboard FKB4850 Series: Compact Design with Superior Key Operability; ©1991 by Fujitsu Limited and Fujitsu Microelectronics, Inc. (2 pages total).

Fujitsu Keyboards FKB4700 Series; ©1990 Fujitsu Limited of Tokyo, Japan (4 pages total).

SMK Keyboards Catalogue, particularly noting pp. 53-60 for SMK Standard Keyboard and 61-86 for Custom Made Keyboards (113 pages total).

*Primary Examiner*—Henry J. Recla
*Assistant Examiner*—David J. Walczak
*Attorney, Agent, or Firm*—Pravel, Hewitt, Kimball & Krieger

[57] ABSTRACT

A low profile keyswitch having bearing surfaces on both the inside and outside of the plunger of the keycap member is disclosed. The key switch includes a one-piece switch chimney having a cylindrical upright member, a plurality of arcuate ribs positioned coaxially inwardly of the cylindrical member along with a membrane support member. The chimney receives the cylindrical plunger between the cylindrical member and the ribs to provide bearing surfaces on the plunger closest to the keycap member actuation point to minimize friction when the keycap member is depressed offcenter thereby reducing binding of the keyswitch. A plurality of equidistance upstops are disposed on the lower-end of the plunger to reduce wobble of the keycap member in the extended position.

23 Claims, 3 Drawing Sheets

FIG. 9
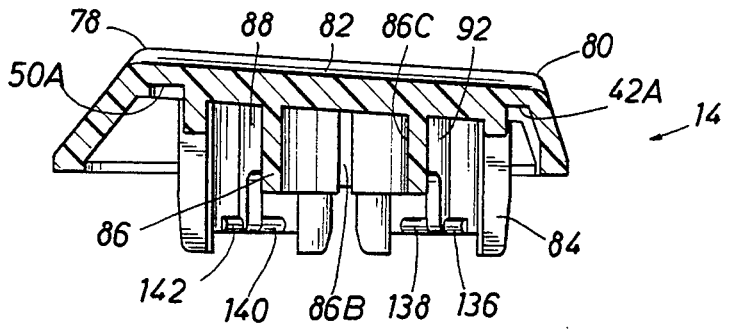
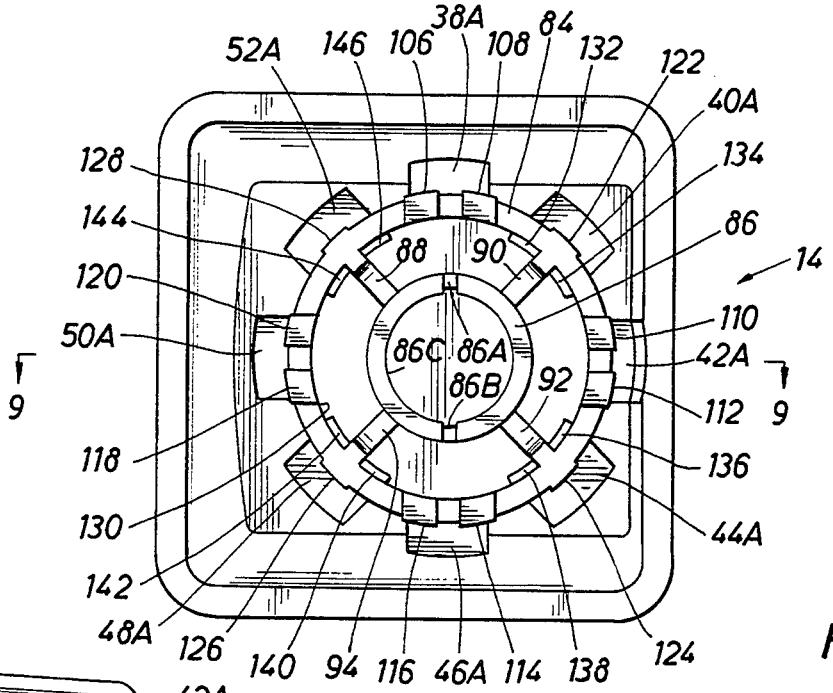
FIG. 10
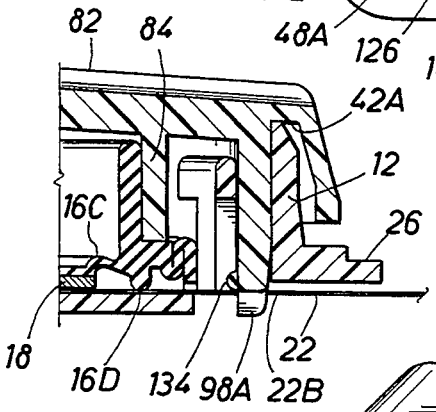
FIG. 2B
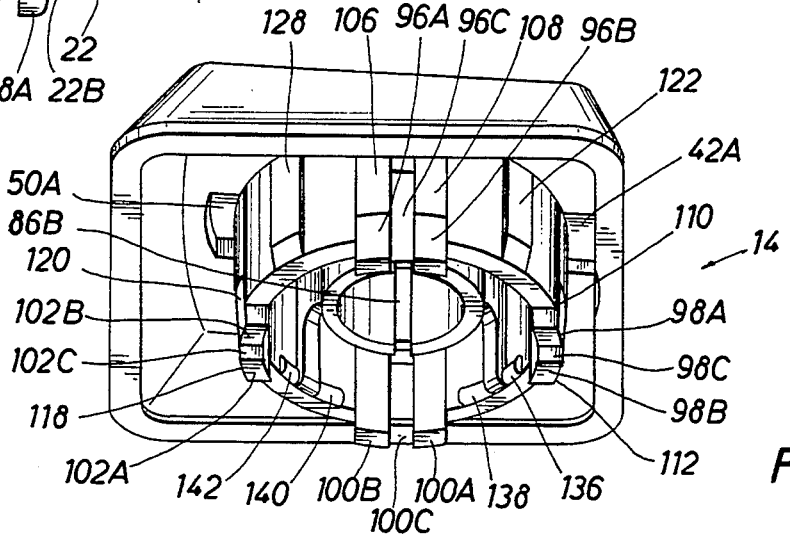
FIG. 11

FIG. 5
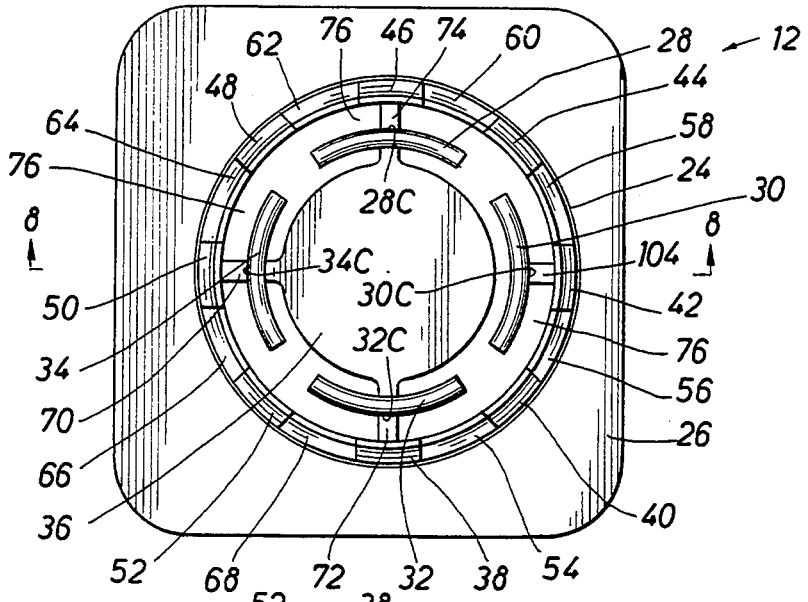
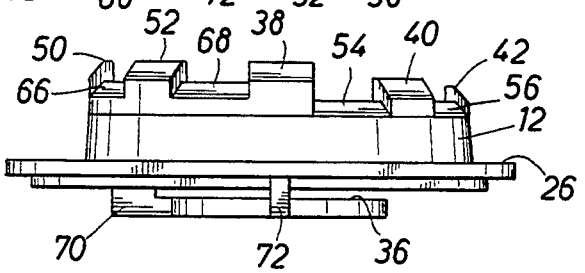
FIG. 6
FIG. 7
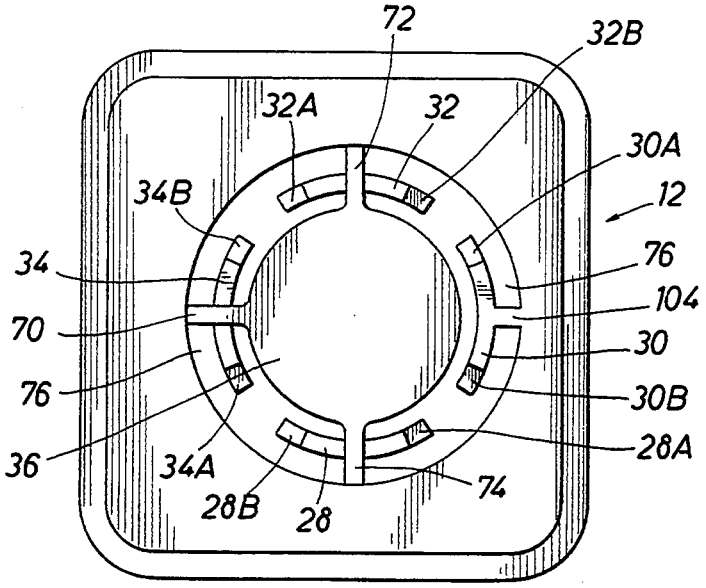
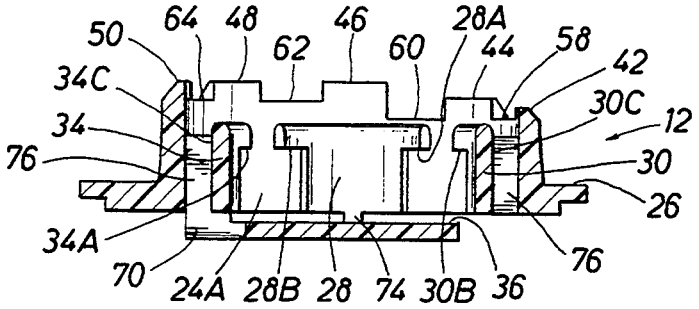
FIG. 8

LOW PROFILE KEYSWITCH

This is a continuation of co-pending application Ser. No. 08/044,593 filed on Apr. 8, 1993, now abandoned.

BACKGROUND OF THE INVENTION

This invention relates to a keyswitch, particularly to a low profile keyswitch for use with a computer keyboard, calculator and other electronic machines that process data and information.

DESCRIPTION OF THE RELATED ART

There are a wide variety of keyswitches for use with calculators and computer keyboards. The keyswitches of particular interest are those having a plurality of individual, discrete keys projecting from their support such as in a computer keyboard.

Each keyswitch includes a keycap member on which there is an actuation surface for the user to press. Each keyswitch further includes a keyswitch chimney or housing to maintain the keycap member. Conductive contact pads are provided with the keyswitches to make the electrical contact with the leads on a membrane. An urging means, such as a spring or a yieldable dome usually made of rubber, is provided between the keycap member and the membrane to urge the keycap member away from the membrane so that electrical connection between the conductive pad occurs only when actuated.

Keyswitches for computer keyboards have been fabricated with a yieldable dome for a quiet tactile operation. In a quiet tactile mode, a plunger of the keycap member engages the leads in the membrane indirectly through the dome. Keyswitches for computer keyboards have also been fabricated for a click tactile operation where the plunger directly engages the leads in the membrane.

U.S. Pat. No. 4,939,324 discloses both the quiet tactile (FIGS. 8–9) and click tactile (FIGS. 1, 10) embodiments of a keyswitch. In the click tactile embodiment, a single cylindrical upright switch chimney is positioned above a yieldable dome. A keycap member having an outer cylindrical plunger and an inner actuator rod is sized to be coaxially slidably positioned in the chimney. In the click tactile embodiment, before the keycap member is positioned in the chimney, a piston is coaxially received about the inner actuator rod of the keycap member with a coil spring positioned about the rod between the keycap member and the piston.

Because the force of the spring in the non-depressed position is selected to be less than the biasing of the resistive force of the dome, depression of the keycap member in U.S. Pat. No. 4,939,324 will cause the spring to compress until the force exerted by the spring is sufficient to move the dome towards the underlying membrane. Therefore, though the keycap member cylindrical plunger is slidably positioned between the chimney and the piston there is relative sliding movement between the cylindrical plunger and the piston. In other words, the piston of U.S. Pat. No. 4,939,324 is not fixed relative to the chimney.

The inner surface of the chimney of U.S. Pat. No. 4,939,324 includes alternating diverging cone and flat surfaces. Also, neither the plunger or rod actuator of the keycap member of U.S. Pat. No. 4,939,324 in the quiet tactile mode nor the plunger and piston in the click tactile mode pass through the membrane. Additionally, the keyswitch in U.S. Pat. No. 4,939,324 discloses only a single ramp or blocking member on the plunger to engage a projection on the upright chimney. Therefore, the plunger, when extended, will tend to pivot about the ramp as a fulcrum so that the top of the keycap member will be biased towards the front of the keyboard.

Recently, low profile keyswitches have become popular. These low profile keyswitches are intended for use in portable devices such as notebook, laptop or palm computers. In these portable computers it is desirable that the keyboard have individual discrete key elements where the height of the keyboard is relatively small. Ideally, such a keyboard will be in the range of 10–22 mm in height and preferably no more than ½" (12.5 mm) high or even less if possible. Such a keyboard should also be as light as possible to keep the total weight of the portable computer low, preferably in the range of 150 to 500 grams.

U.S. Pat. No. 5,115,106 discloses a low profile keyswitch. The keyswitch in U.S. Pat. No. 5,115,106 discloses a plunger having two arms that are inserted into the bore of a cylindrical chimney. Upon insertion into the chimney, tabs at the lower end of each arm extend radially outwardly from a compressed position into corresponding slots in the cylindrical chimney. These two plunger tabs resist withdrawal of the plunger from the chimney. However, when a predetermined pulling force is achieved both tabs will move inwardly to clear the projection in the chimney bore. The keycap member includes a lower shoulder independent of the plunger that engages the yieldable dome so that when the keycap member is depressed, a conductive pad on the yieldable dome contacts the membrane while the plunger extends through the membrane.

Neither U.S. Pat. No. 4,939,324 nor U.S. Pat. No. 5,115,106 disclose a chimney having a first upright member having an inner bearing surface and a second upright member having an outer bearing surface where the chimney bearing surfaces are fixed relative to each other so that a plunger of a keycap member can be slidably engaged between the inner and outer bearing surfaces.

A keyswitch having a plunger with inner and outer bearing surfaces between two fixed chimney uprights would minimize friction when the keycap is depressed offcenter. Keyswitches without bearing surfaces on the inner surface of the plunger, such as shown in U.S. Pat. No. 5,115,106, could permit the keyswitch to bind. A keyswitch having dual bearing surfaces that will place the bearing surfaces on the inner and outer surfaces of the plunger closest to the key actuation point would be desirable. This dual bearing surface would result in significantly less friction force at the bearings. Additionally, a keyswitch using multiple upstops or blocking members spaced equidistance about the plunger to reduce the perception of key wobble in a preloaded extended position would be desirable. Additionally, a keyswitch having a one-piece chimney including first and second upright members and a membrane support member would reduce weight, cost and profile height of the keyswitch. Also, a membrane adapted for use with the membrane support platform having a C-shaped opening to facilitate assembly of the keyswitch would be desired to reduce manufacturing costs.

SUMMARY OF THE INVENTION

A low profile keyswitch including a one-piece switch chimney having a cylindrical upright member, a plurality of arcuate ribs and a membrane support member is provided. The cylindrical upright member is fixed relative to the arcuate ribs.

A keycap member, having a cylindrical plunger, is movable between an extended position and a depressed position in the switch chimney. The plunger has an inner bearing surface and an outer bearing surface. The plunger's outer bearing surface slidably engages the cylindrical upright member inner bearing surface and the plunger inner bearing surface slidable engages the arcuate rib outer bearing surface. Therefore, bearing surfaces are provided on the inner and outer bearing surfaces of the plunger closest to the keycap member actuation point to reduce binding of the low profile keyswitch.

A membrane having a C-shaped opening and another opening is provided to be positioned on the membrane support member of the chimney. Bottom portions of the plunger extend through the openings in the membrane when the plunger is in the fully depressed position.

Coaxially inwardly positioned from the cylindrical plunger is a cylindrical actuator. A yieldable dome engages the actuator to urge the keycap member to the extended position.

A plurality of equidistant blocking members or upstops are disposed on the lower end of the plunger to interengage with shoulders on the plurality of arcuate ribs to reduce wobble of the keycap member in the extended position.

BRIEF DESCRIPTION OF THE DRAWINGS

The objects, advantages and features of the invention will become more apparent by reference to the drawings which are appended hereto and wherein like numerals indicate like parts and wherein an illustrated embodiment of the invention is shown, of which:

FIG. 2B is a partial view similar to FIG. 2A with the keyswitch of the present invention in the fully depressed position;

FIG. 5 is a plan view of the switch chimney of the present invention;

FIG. 6 is an elevational view of the switch chimney of the present invention;

FIG. 7 is a bottom view of the switch chimney of the present invention;

FIG. 8 is a section view taken along lines 8—8 of FIG. 5;

FIG. 9 is an elevational section view of the keycap member of the present invention taken along line 9—9 of FIG. 10;

FIG. 10 is a bottom view of the keycap member of the present invention; and

FIG. 11 is a bottom side perspective view of the keycap member of the present invention.

DETAILED DESCRIPTION OF THE PREFERRED EMBODIMENT

Figure 1:
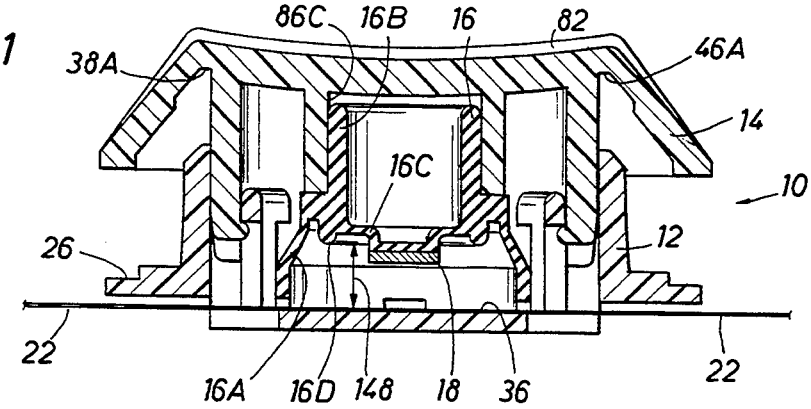
FIG. 1 is a front elevational section view of the keyswitch of the present invention in the extended position.

As seen in the FIGS., the keyswitch of the present invention, generally indicated as 10, includes a switch housing or chimney 12 and a keycap member 14. Interposed between the keycap member 14 and the chimney 12 is a quiet tactile type yieldable dome 16 including a conductive pad 18 for electrically connecting the leads 20A, 20B of membrane 22.

Turning now to FIGS. 5 through 8, the one-piece switch chimney 12 is shown independent of the yieldable dome 16, the keycap member 14, and membrane 22. As best shown in FIG. 5, the preferred embodiment of the chimney 12 is fabricated from acetal and includes a generally cylindrical upright member 24 extending upwardly from a plate 26. Radially inwardly from the cylindrical member 24 are four equidistant spaced arcuate ribs 28, 30, 32, and 34. Also, as can be seen in FIG. 5 is the top of the membrane support member 36. As best seen in FIGS. 5, 6, and 8, the top portion of the cylindrical member 24 includes a number of upwardly projecting tabs 38, 40, 42, 44, 46, 48, 50, and 52. As can be seen the projecting tabs decrease in height as they extend from the front of the keyswitch to the rear or from the tab 50 to the tab 42 with tabs 38 and 46; tabs 48 and 52; and tabs 40 and 44 being of the same height. Intermediate each of these tabs are located a lower height edge 54, 56, 58, 60, 62, 64, 66, and 68 that also decrease in height from the front to the rear. The tabs 38–52 and the edges 54–68 both slant downwardly, radially outwardly from the keyswitch, as best seen in FIGS. 6 and 8. The membrane support member 36 is connected to the plate 26 by three legs 70, 72, and 74. As best seen in FIGS. 1, 2A, 2B, 3, 7, and 8, each rib has a shoulder 28A, 28B, 30A, 30B, 32A, 32B, 34A, 34B. The switch chimney 12 includes the outer bearing surface 28C, 30C, 32C and 34C on their respective ribs 28–34. The inner bearing surface 24A of member 24 is cylindrical, as best seen in FIGS. 1–3 and 8. The arcuate ribs 28–34 and the cylindrical member 24 create an annulus 76 therebetween.

Turning to FIGS. 9–11, the keycap member, generally indicated at 14, is shown as a separate component to better illustrate its features. As best shown in FIG. 9, keycap member 14 has its highest actuation point near the front at 78 and its lowest actuation point is near the rear at 80 of the keycap 82 of the keycap member 14. The keycap member 14 is preferably fabricated from ABS, though other equivalent plastics could be used. A generally cylindrical plunger 84 is spaced radially outwardly from a cylindrical actuator 86, both of which will be described below in detail. A number of connector bars 88, 90, 92, and 94 structurally support the plunger 84 with the actuator 86. Indentations 38A, 40A, 42A, 44A, 46A, 48A, 50A, and 52A, receive the corresponding upwardly projecting tabs 38–52, as best shown in FIGS. 5, 6, and 8, of the switch chimney 12 to increase the overall travel length of the keycap member 14 relative to the chimney. These indentations 38A–52A also provide an upper surface to stop the downward travel of the keycap member 14 relative to the switch chimney 12. As can also be seen, the indentations 38A–52A decrease in height from front to rear to correspond to the tabs 38–52.

The plunger 84 comprises four sets of guide members that include guide members 96A, 96B defining a channel 96C therebetween; guide members 98A, 98B defining a channel 98C therebetween; guide members 100A, 100B defining a channel 100C therebetween; and guide members 102A, 102B defining a channel 102C therebetween. The leg 104 of the chimney is received in channel 98C, leg 74 is received in channel 100C, leg 72 is received in channel 96C and leg 70 is received in 102C. On each of the guide members 96–102, an outwardly protruding ramp is provided for engagement with the cylindrical inwardly facing surface 24A of the chimney 12. In particular, ramps 106, 108 are located on the guide members 96A and 96B respectively; ramps 110, 112 are located on guide member 98A and 98B respectively; ramps 114 and 116 are located on guide members 100A and 100B respectively; and ramps 118 and 120 are located on guide members 102A and 102B respectively. Located between the guide members 96A and 96B, 98A and 98B, 100A and 100B, and 102A and 102B is an additional outwardly protruding ramp member for engagement with the inwardly facing surface 24A of the cylindrical upright 24 including ramp 122, ramp 124, ramp 126, ramp 128. The inwardly facing surface 130 of the plunger 84 is designed to engage the outwardly facing surface 28C, 30C, 32C and 34C of the arcuate ribs 28–34.

The generally cylindrical actuator 86, located radially inward of the plunger 84, includes two slots 86A and 86B to receive the yieldable dome 16, that will be discussed below in detail. The inside surface 130 of the plunger 84 also includes a plurality of inwardly facing blocking members or upstops that are spaced equidistant about the plunger. Blocking members 132 and 134 are located on each side of bar 90 to engage rib shoulders 32B and 30A, respectively. Blocking members 136 and 138 are disposed on each side of bar 92 to engage rib shoulders 30B and 28A, respectively. Blocking members 140 and 142 are disposed on each side of bar 94 to engage rib shoulders 28B and 34A, respectively. Blocking members 144 and 146 are disposed on each side of bar 88 to engage rib shoulders 34B and 32A, respectively.

Figure 2A:
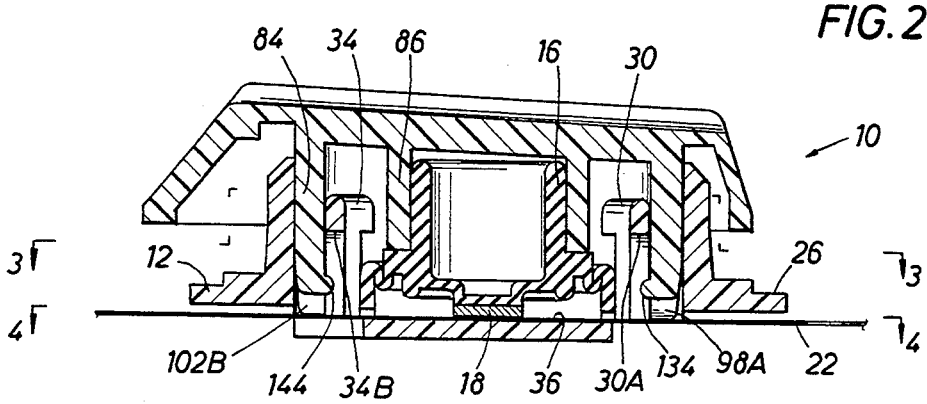
FIG. 2A is a side view of the keyswitch of the present invention in the partially depressed position where the ribs and respective upstops have been rotated 45° into FIG. 2A to illustrate the interengagement of the upstops to the ribs.
Figure 3:
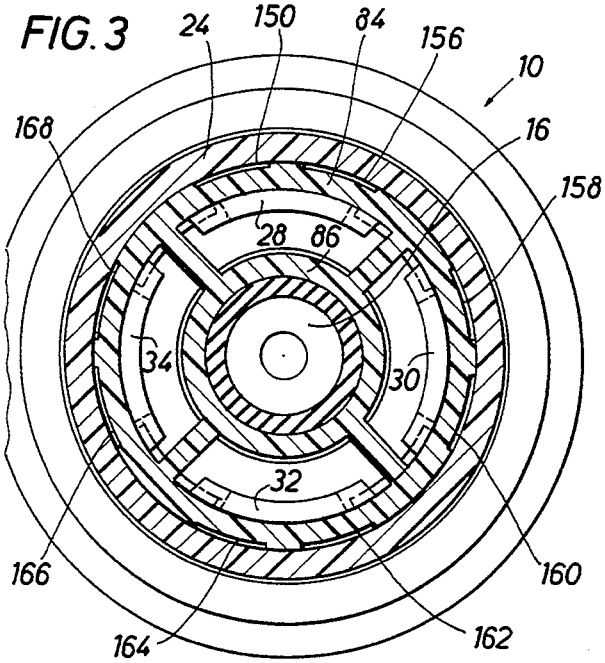
FIG. 3 is a section view taken along line 3—3 of FIG. 2A without rotating the rib and upstops 45° into FIG. 2A.
Figure 4:
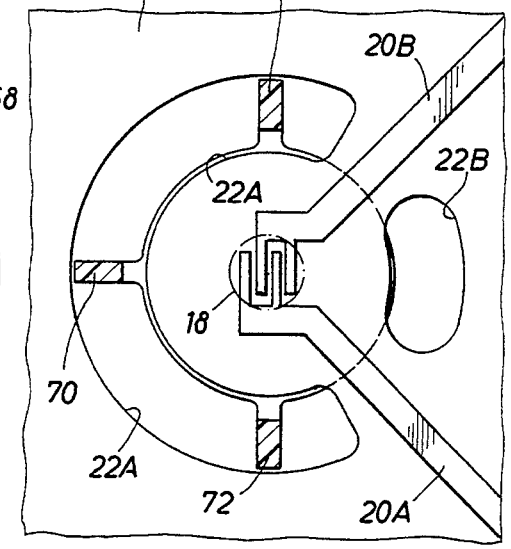
FIG. 4 is a section view taken along line 4—4 of FIG. 2A.

Turning now to FIGS. 1–4, the keyswitch 10 is shown assembled. To assemble the keyswitch 10, the membrane 22 having a C-shaped opening 22A and a second smaller opening 22B are positioned about the legs 70–74 of the switch chimney 12. As best shown in FIGS. 4 and 6, the surface to the left of the C-shaped opening 22A of membrane 22 is positioned under the membrane support member 36 and the surface to the right of the C-shaped opening 22A is positioned above the membrane support member 36 until the left surface is received adjacent to leg 70, as shown in FIG. 4. This C-shaped opening 22A facilitates assembly of the keyswitch to reduce manufacturing costs. The leads 20A and 20B are thereby automatically positioned for engagement with the conductive pad 18 to provide the electrical connection.

After the membrane 22 has been positioned on the membrane support member 36, the yieldable dome 16 is positioned between the ribs 28–34. In particular, the collapsible leg 16A is axially positioned adjacent the ribs, thereby axially positioning the upper cylindrical portion 16B. The portion 16C of the yieldable dome 16 closes off the cylindrical member 16B on one side and the other side carries the conductive pad 18. A cylindrical nub 16D also is provided on the bottom of the yieldable dome preferably 0.079 inches (2 mm) from the membrane 22, as indicated at 148 when the keyswitch 10 is in the fully extended position. As can be seen the upper cylindrical portion 16B of the yieldable dome 16 is sized to provide a friction fit engagement with the inner surface 86C of the actuator 86. The slots 86A and 86B provide an air flow passage during initial assembly and for when portion 16C of the yieldable dome 16 moves. As best shown in FIGS. 1–3 and as previously discussed, the upstops or blocking members 132–146 engage the shoulders on the ribs 28–34. The rib members 30A and 34B and their respective blocking members 134 and 144 as shown in FIG. 2A have been rotated 45° into the Fig. to better show the interengagement of the upstops to the shoulders of the ribs.

When the keyswitch is partially depressed, as shown in FIG. 2A, the conductive pad 18 engages the membrane 22. Upon further actuation of the keycap 82 of the keycap member 14, the bottom portion of guide members 96–102 of the plunger 84 extend through the holes 22A and 22B of the membrane 22 until the upper tabs 38–52 of the chimney 12 engage their respective indentations 38A–52A to prevent further downward travel of the keycap member 14 relative to the chimney 12, as best shown in FIG. 2B. When the keycap is fully depressed, the nub 16D of dome 16 engages the membrane 22 to distribute the loading.

As best shown in FIG. 3, when the plunger 84 of the keycap member 14 is pressed in the annulus 76 of the chimney switch 12, the outer surface of the plunger ramps 106–128 engage the surface 24A of the cylindrical upright member 24 providing a number of gaps 150–168 therebetween.

In the fully extended position the keyswitch 10 preferably has a height from the bottom of the membrane support member 36 to the highest point of the keycap member at 78 of 0.354 inches (9 mm) which is within the desirable range of a low profile keyswitch while providing dual bearing surfaces which minimize friction when the keycap member is depressed offcenter.

These dual bearing surfaces along with indentations 38A–52A and a plunger 84 that extends through the membrane 22 provide a maximum bearing travel length in a low profile keyswitch. Since the bearing surfaces are always on the plunger outside diameter and inside diameter closest to the keycap 82 actuation point, less friction force is created in the bearings and there is less tendency for the keycap member 14 to bind.

The multiple upstops or blocking members 132–146 spaced equidistant about the inner surface of the plunger 84 decreases the perceived key wobble when the keycap member 14 is in the extended position, as shown in FIG. 1.

While the invention is described with reference to membrane switches, it is to be understood that it is equally applicable to capacitive keyswitch technology.

A typical keyboard would include a plurality of keyswitches. Since each keyswitch is identical in structure, only one has been shown in the drawings for illustrative purposes.

The foregoing disclosure and description of the invention are illustrative and explanatory thereof, and various changes in the size, shape and materials, as well as in the details of the illustrated construction may be made without departing from the spirit of the invention.

I claim:

1. A keyswitch, comprising a switch chimney including a first upright member, a second upright member and a membrane support member;

said first upright member having an inner bearing surface;

said second upright member having an outer bearing surface, said first upright member being disposed radially outwardly and fixed relative to said second upright member;

said membrane support member disposed radially inwardly of said second upright member;

a plunger having a top end and a bottom end movable between an extended position and a depressed position and having an inner bearing surface and outer bearing surface, said plunger inner bearing surface slidably engaging said second upright outer bearing surface and said plunger outer bearing surface slidably engaging said first upright inner bearing surface; and a membrane received on said membrane support member having at least one opening, wherein said plunger bottom end extends through said membrane opening when said plunger is in said depressed position.

2. The keyswitch of claim 1 wherein said first upright member is substantially cylindrical, and said second upright member includes at least one arcuate rib.

3. The keyswitch of claim 1 wherein said second upright member includes a plurality of equidistant arcuate ribs.

4. The keyswitch of claim 3 wherein said plunger has a plurality of blocking members to engage said ribs to limit further extension of said plunger.

5. The keyswitch of claim 1 wherein said membrane includes a first opening and a second opening, and said plunger bottom end includes a first portion and a second portion wherein said first portion extends through said first opening and said second portion extends through said second opening.

6. The keyswitch of claim 1 further comprising an urging means to urge said plunger to said extended position.

7. The keyswitch of claim 6 further comprising a keycap member including said plunger and an actuator, said actuator being spaced apart from said first and second upright members to engage said urging means, wherein said urging means urges said keycap to said extended position.

8. The keyswitch of claim 1 further comprising a cylindrical actuator attached and coaxially spaced apart from said plunger, and a yieldable dome for urging said actuator to said extended position having an upper cylindrical portion, said dome upper cylindrical portion being interengaged with said cylindrical actuator.

9. The keyswitch of claim 1 further comprising a keycap member having a predetermined height and a top and said membrane support member having a bottom wherein the height of said keyswitch in the extended position from the top of said keycap member to the bottom of said membrane support member is less than 10 mm.

10. The keyswitch of claim 1 further comprising a yieldable dome having a conductive pad to urge said plunger to said extended position, wherein said conductive pad engages said membrane.

11. A keyswitch, comprising a switch chimney including a first upright member and a second arcuate upright member, said first cylindrical upright member having an inner bearing surface, said second arcuate upright member coaxially disposed with said first upright member and having an outer bearing surface, a keycap member having a plunger and an actuator wherein:

said plunger movable between an extended position and a depressed position having an inner bearing surface and an outer bearing surface, said plunger inner bearing surface slidably engaging said second upright outer bearing surface and said plunger outer bearing surface slidably engaging said first upright inner bearing surface, and said actuator disposed radially inwardly from said first upright member and said second upright member, and an urging means having an upper portion fixed relative to said actuator to urge said keycap member to said extended position.

12. The keyswitch of claim 11 wherein said actuator is substantially cylindrical and coaxially spaced apart and radially inwardly disposed from said plunger, said keyswitch further comprising said urging means having an upper cylindrical portion, said upper cylindrical portion being interengaged with said cylindrical actuator.

13. The keyswitch of claim 11 further comprising a membrane having a first opening and a second opening, said membrane received on said switch chimney, and said plunger having a first portion and a second portion wherein said first portion extends through said membrane first opening and said second portion extends through said membrane second opening.

14. A keyswitch, comprising a one piece switch chimney including:

a first upright member having an inner bearing surface, a second upright member spaced radially inwardly from said first upright member having an outer bearing surface, and a membrane support member inwardly disposed from said second upright member, and a plunger movable between an extended position and a depressed position having an inner bearing surface and an outer bearing surface, said plunger inner bearing surface slidably engaging said second upright outer bearing surface and said plunger outer bearing surface slidably engaging said first upright inner bearing surface.

15. The keyswitch of claim 14 wherein said first upright member is substantially cylindrical and said second upright member includes at least one arcuate rib.

16. The keyswitch of claim 14 wherein said second upright member includes a plurality of equidistant arcuate ribs.

17. The keyswitch of claim 14 further comprising a membrane positioned on said membrane support member and having a first opening and a second opening, and said plunger includes a first portion and a second portion wherein said plunger first portion extends through said membrane first opening and said plunger second portion extends through said membrane second opening.

18. The keyswitch of claim 14 further comprising
an urging means to urge said plunger to said extended position; and
a keycap member including said plunger and an actuator spaced apart from said first and second upright members, said actuator engaging said urging means, wherein said urging means urges said keycap member to said extended position.

19. The keyswitch of claim 14 further comprising
a cylindrical actuator attached and coaxially spaced apart from said plunger, and
a yieldable dome for urging said actuator to said extended position having an upper cylindrical portion, said upper cylindrical portion being interengaged with said cylindrical actuator.

20. A keyswitch, comprising
a keyswitch chimney including:
a first upright member having an inner bearing surface;
a second upright member having an outer bearing surface;
a plunger movable between an extended position and a depressed position having an inner bearing surface and outer bearing surface, said plunger inner bearing surface slidably engaging said second upright outer bearing surface and said plunger outer bearing surface slidably engaging said first upright inner bearing surface;
one of said upright members including at least four spaced apart arcuate ribs, each of said ribs having at least one shoulder; and
a plurality of blocking members disposed on said plunger to engage said plurality of arcuate rib shoulders on one of said upright members to reduce wobble of the keyswitch in the extended position.

21. The keyswitch of claim 20 wherein said second upright member includes said arcuate ribs.

22. The keyswitch of claim 21 wherein said blocking members are spaced equidistant to engage said arcuate rib shoulders to reduce wobble of the keyswitch in the extended position.

23. The keyswitch of claim 20 further comprising
an urging means to urge said plunger to said extended position, and
a keycap member including said plunger and an actuator spaced apart from said first and second upright members, said actuator engaging said urging means, wherein said urging means urges said keycap member to said extended position.

* * * * *